United States Patent [19]

Evans

[11] 4,194,858

[45] Mar. 25, 1980

[54] MINE ROOF BOLT ANCHOR INSTALLATION

[75] Inventor: Gordon C. Evans, Syracuse, N.Y.

[73] Assignee: The Eastern Company, Naugatuck, Conn.

[21] Appl. No.: 945,225

[22] Filed: Sep. 25, 1978

[51] Int. Cl.[2] ..... E21D 20/02

[52] U.S. Cl. ..... 405/259; 85/63; 85/79; 405/261

[58] Field of Search ..... 405/259, 260, 261, 262; 85/1 R, 63, 79

[56] References Cited

U.S. PATENT DOCUMENTS 3,188,815 6/1965 Schuermann et al. ..... 405/261

FOREIGN PATENT DOCUMENTS 2126554 12/1971 Fed. Rep. of Germany ..... 405/259

405204 7/1966 Switzerland ..... 405/259

*Primary Examiner*—David H. Corbin

*Attorney, Agent, or Firm*—Charles S. McGuire

[57] ABSTRACT

A coil spring having fixedly attached washer members at each end encircles a mine roof bolt and is retained between radially projecting ears on the bolt and an expansion anchor threaded on the bolt. The washer member which engages the bolt ears is slotted to receive the ears so that rotation of the bolt is transmitted to the spring and the other washer member. The washer member at the other end has a pair of stepped shoulders on the face opposite the spring which engages the lower end of the anchor shell. The latter is also provided with a pair of stepped shoulders which cooperate with those on the washer member to transmit rotation from the bolt to the anchor in one direction and allow relative rotation in the other. In this manner, a resin grouting cartridge placed in the drill hole ahead of the anchor may be broken and its contents mixed by rotation of the bolt and anchor as a common unit, and the anchor expanded to tension the bolt as the resin sets by rotation in the opposite direction.

10 Claims, 6 Drawing Figures

MINE ROOF BOLT ANCHOR INSTALLATION

BACKGROUND OF THE INVENTION

The present invention relates to mine roof bolt anchoring and, more specifically, to improved apparatus for use in a combined mechanical-resin bolt anchoring system.

In copending U.S. application Ser. No. 882,797 of Carl A. Clark and John Rogalla, assigned to applicant's assignee, is disclosed bolt anchoring apparatus and methods which involve common rotation of the bolt and an associated expansion anchor to break a two-compartment resin package and mix the contents thereof. Cooperating structure on, or in association with, the bolt and anchor cause the two to be rotated together, i.e., relative rotation is prevented, when the bolt is turned in a counter-clockwise direction. The cooperating structure allows relative rotation in the opposite direction, however, whereby the anchor may be held stationary as the bolt is rotated in the clockwise direction to advance into the tapered nut and effect expansion of the anchor. The advantages of such a system are discussed more fully in the aforementioned application, as are the various prior art systems.

In practise, it has been found that at least some forms of the apparatus described in the aforementioned application encounter excessive friction between the bolt and anchor as the bolt is rotated in the clockwise direction. Therefore, instead of the anchor remaining rotationally stationary to permit advancement of the bolt into the tapered nut to cause expansion of the shell, it is rotated with the bolt as in the counter-clockwise direction. Thus, in some cases the shell does not expand and the bolt is not tensioned as desired.

It is the principal object of the present invention to provide an improved construction for transmitting rotation from a roof bolt to an expansion anchor in one direction while allowing relative rotation in the opposite direction.

Another object is to provide a resilient coupling for use with a mine roof bolt and associated expansion anchor which effectively transmits rotation from the bolt to the anchor in one direction while allowing relative rotation by offering very little frictional resistance in the opposite direction to insure expansion of the anchor.

Other objects will in part be obvious and will in part appear hereinafter.

SUMMARY OF THE INVENTION

A mine roof bolt is threaded at one end and provided with a pair of radially extending ears just below the threaded portion, as is conventional in many rock bolts currently in use. An anchor is comprised of a tapered nut and a shell having a collar at one end with a plurality of radially expansible fingers extending integrally therefrom. The anchor is also conventional in all respects except that the lower face of the collar is formed with a pair of sloped or spiral surfaces each terminating in a stepped shoulder. Shells having similar collar surfaces are also disclosed in aforementioned application Ser. No. 882,797.

A separate element is provided for engagement between the bolt and anchor to effect rotational transmission in one direction only. The element comprises a coil spring having washer-like members affixed to each end so that the washers lie in substantially parallel planes with their openings coaxial with the spring axis. The washer openings and spring diameter are slightly larger than the bolt with which the element is used so that it may be placed in encircling relation to the bolt.

One of the washer members is provided with a pair of radial slots at its inner periphery. The element is placed over the threaded end of the bolt with the slotted washer engages the ears on the bolt. The expansion anchor is then placed on the bolt which is threaded into the tapered nut until the washer element at the top of the spring engages the lower end of the shell, i.e., the lower surface of the shell collar.

The opposing surfaces of the washer and shell collar are both formed with a pair of sloping surfaces terminating in stepped shoulders. The element is rotated together with the bolt due to the engagement of the bolt ears in the slots of the lower washer. The stepped shoulders on the upper washer and shell collar are in opposition when the bolt is rotated in the counter-clockwise direction, whereby the rotation is transferred through the spring element to the anchor, with the entire assembly being rotated as a common unit. When the bolt is rotated in the clockwise direction the shoulders are not in opposition, whereby any tendency of the anchor to remain rotationally stationary will not be disturbed by the minimal friction of the sliding engagement of the upper washer with the anchor shell collar. That is, since the washer is resiliently urged by the spring into contact with the collar, it can easily slide on the collar surface when the shoulders are not in opposition. This allows the resin cartridge to be broken and its contents mixed while rotating the assembly in the counter-clockwise direction, and the shell to be immediately thereafter expanded to be firmly anchored for tensioning the bolt by rotation in the clockwise direction as the resin grouting begins to set.

DETAILED DESCRIPTION

Figure 1:
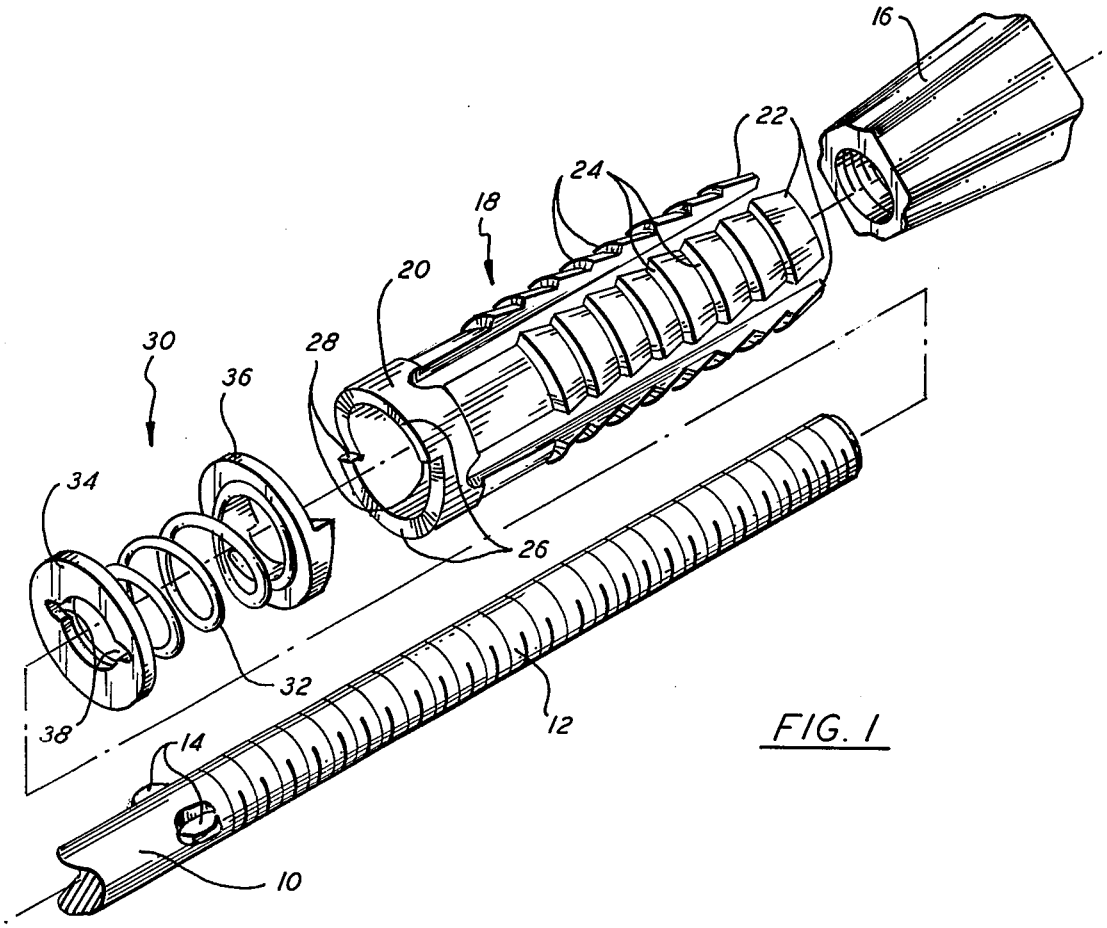
FIG. 1 is an exploded, perspective view showing a portion of the bolt, a typical expansion anchor and the resilient coupling element of the invention.

Referring now to the drawings, in FIG. 1 is shown a fragment of a conventional roof bolt having a shaft 10 with threads 12 extending from one end for a portion of its length. A pair of ears 14 are formed in conventional fashion on shaft 10 by pinching portions of the metal to extend radially outward from the shaft, integrally therewith. An expansion anchor comprising tapered nut 16, having an internally threaded axial bore, and expansion shell 18, is carried on the threaded end of the bolt.

Shell 18 is formed with a circular collar 20 at its base and, extending integrally therefrom, a plurality of radially expansible fingers 22 each having external gripping teeth 24. The lower end of collar 20 is provided with a pair of sloped or spiral surfaces 26 terminating in stepped shoulders 28. The expansion anchor is conventional in all respects except for the provision of surfaces 26 and shoulders 28 on the lower end of the collar, which is normally planar. Thus, the anchor may take any of a wide variety of common forms provided stepped shoulders 28 or equivalent structure is associated with the lower end thereof. Surfaces 26 and shoulders 28 may be formed as a separate element and attached to the lower end of shell 18 or, preferably, be cast or ground integrally with the shell end.

Figure 2:
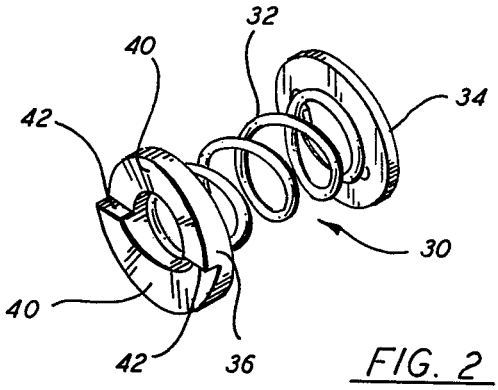
FIG. 2 is a perspective view of the coupling element of FIG. 1, as seen from the opposite end.

A separate element generally denoted by reference numeral 30 comprises coil spring 32 having washer-like members 34 and 36 fixedly attached to the opposite ends thereof. The openings in washers 34 and 36 and that defined by the inner periphery of spring 32 are slightly greater in diameter than bolt shank 10, whereby element 30 may be placed in encircling relation to the bolt. A pair of slots 38 extend outwardly from the edge of the opening in washer member 34, on opposite sides thereof, and are dimensioned for engagement of ears 14 therein. Washer member 36, as best seen in FIG. 2, is formed with a pair of sloped or spiral surfaces 40 terminating in stepped shoulders 42, similar to those on the lower surface of shell collar 20.

The elements are assembled, as indicated by the dot-dash line in FIG. 1, by placing element 30 over the threaded end of the bolt with washer 34 going over first so that it will rest upon ears 14 which engage in slots 38, whereby element 30 is rotationally fixed with respect to the bolt. The anchor is then assembled with the bolt by passing collar 20 over the bolt end and advancing threads 12 into the internal threads of nut 16. Surfaces 26 of the lower end of shell 18 then rest upon surfaces 40 of washer 36 and the assembly is ready for use.

Referring now to FIGS. 3–6, conventional resin cartridge 44 includes two compartments physically separating components 46 and 48 of a resin grouting mix. Such cartridges are commercially available from a variety of sources and include a polyester resin as one of the components and a reaction agent such as a catalyst or curing or hardening agent as the other. The two components remain in a semi-liquid or thixotropic phase until mixed, whereupon the resin begins to solidify. Curing and solidification continue until an extremely strong bond is formed by the resin grout.

Figures 3, 4, 5, 6:
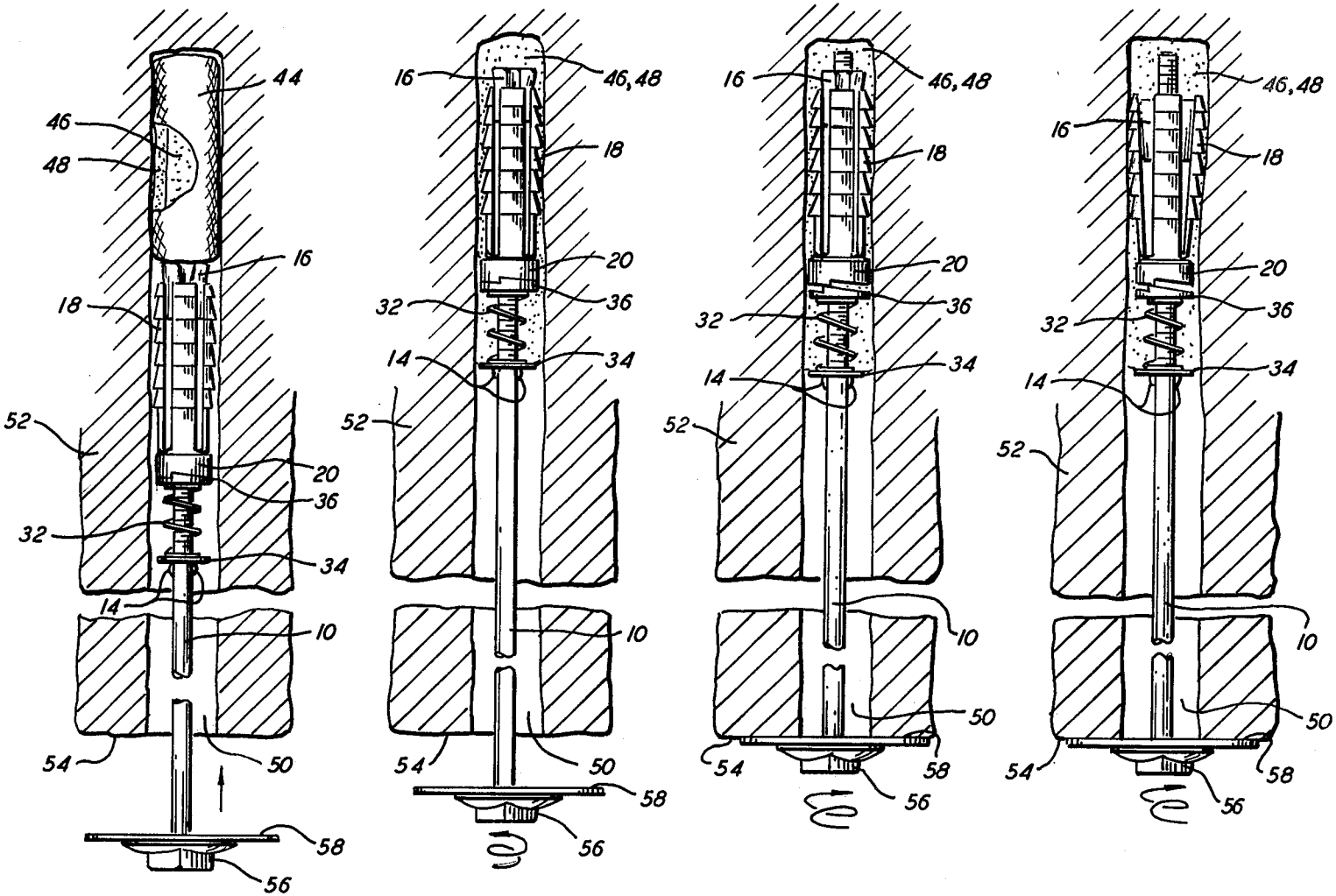
FIGS. 3–6 are a series of cross sectional views through a rock structure having a drill hole formed therein showing, in front elevation, the apparatus of the invention in the various stages of installation.

As seen in FIG. 3, cartridge 44 has been placed in blind drill hole 50 which has been previously formed in rock structure 52, such as the roof of a coal mine, for purposes of installing the elements which will serve to reinforce the rock structure and support surface 54 and the surrounding structure. Bolt shank 10 has an integral head 56 on the end opposite threads 12 which carries support plate 58. The bolt is placed into hole 50, with the expansion anchor and element 30 carried thereon, behind cartridge 44. Head 56 is surface 54 and the surrounding structure. Bolt shank 10 has an integral head 56 on the end opposite threads 12 which carries support plate 58, and is placed into hole 50, with the expansion anchor and element 30 carried thereon behind cartridge 44. Head 56 is engaged by a socket tool (not shown) such as employed in bolting machines in coal mines and elsewhere, which is power driven to move the bolt upwardly into the drill hole and to rotate it in either direction. Threads 12 and those within nut 16 are of the right-hand type so that clockwise rotation of the bolt advances it into the nut as the latter is held rotationally stationary.

Bolt 10 is initially moved into drill hole 50 until cartridge 44 reaches the blind end of the hole, as shown in FIG. 3, and is continued to be moved axially and rotated in a counterclockwise direction, causing it to rupture cartridge 44 and mix components 46 and 48, as indicated in FIG. 4. It will be noted that the directions of spiral surfaces 26 and 40 are such that shoulders 28 oppose shoulders 42 during the counter-clockwise rotation which is transmitted from the bolt to element 30 due to the engagement of bolt ears 14 in slots 38 of washer member 34. Thus, the counter-clockwise rotation is also transmitted to the expansion anchor through the opposing shoulders 28 and 42 to cause the entire assembly to rotate as a single unit during mixing of the resin components. The direction of the spiral of coil spring 32 is such that the spring tends to be unwound, rather than compressed, by counter-clockwise rotation.

After a sufficient amount of counter-clockwise rotation to effect essentially even distribution and mixing of the resin components, the direction of rotation is immediately reversed to clockwise, as indicated in FIG. 5. The close fit of expansion shell 18 within drill hole 50 will tend to hold the anchor rotationally stationary. This is true, of course, in either direction of rotation, but the opposing engagement of shoulders 28 and 42 will overcome the frictional engagement between the walls of hole 50 and shell 18 during counter-clockwise rotation. However, as may be seen in FIG. 5, clockwise rotation moves the shoulders apart rather than into engagement. Due to the resilient bias of spring 32 and the spiral shape of opposing surfaces 26 and 40, washer member 36 will be in sliding contact with the lower end of collar 20 with minimal frictional resistance. Thus, since the bolt cannot move axially upward due to engagement of head 56 with plate 58, holding the expansion anchor rotationally stationary while rotating the bolt in a clockwise direction will move nut 16 downwardly along threads 12. This produces the desired radial expansion of fingers 22, causing teeth 24 to engage the walls of hole 50, as seen in FIG. 6. The bolt may be tensioned to the desired degree prior to the hardening of the resin grouting mix to an extent preventing further movement.

From the foregoing, it may be seen that the invention provides an effective and reliable anchor installation which fully utilizes all the advantages of both resin and mechanical type anchoring systems.

What is claimed is:

1. Mine roof bolt anchoring apparatus for use in conjunction with a conventional two-compartment resin grouting cartridge inserted into a blind drill hole in the mine roof ahead of said apparatus, the latter comprising:

(a) an elongated bolt having a head at one end and threaded for a portion of its length from the other end;

(b) an expansion anchor including a tapered nut engaged with the threads of said bolt and a hollow expansion shell through which said bolt passes axially to engage said nut with the smaller end thereof extending into the upper end of said shell;

(c) an engagement surface fixedly associated with the lower end of said shell;

(d) an engagement element coupled to said bolt and having an upper end resiliently biased into contact with said shell engagement surface;

(e) first rotational stop means fixedly associated with said shell engagement surface; and (f) second rotational stop means fixedly associated with said engagement element upper end, said first and second stop means being relatively arranged (i) for positive rotational engagement in response to rotation of said bolt and thereby said rotationally coupled engagement element in the direction tending to withdraw said bolt from said threaded engagement with said tapered nut, whereby said bolt, engagement element and anchor are rotated as a unitary structure, and (ii) for sliding contact of said engagement element upper end with said shell engagement surface in response to rotation of said bolt in the direction tending to advance said bolt into said tapered nut, whereby said anchor may be held rotationally stationary as said bolt and engagement element are rotated to effect expansion of said shell into engagement with the wall of said drill hole.

2. The invention according to claim 1 wherein said first stop means comprises at least one stepped shoulder lying in a plane radially of the shell axis at the terminus of a spiral surface.

3. The invention according to claim 2 wherein said second stop means comprises a second stepped shoulder at the terminus of a spiral surface on said engagement element upper end.

4. The invention according to claim 1 wherein said upper end of said engagement element comprises a washer-like member having a central opening of larger diameter than said bolt.

5. The invention according to claim 4 wherein said engagement element further comprises a lower washer-like member and a coil spring having an inner diameter larger than said bolt, said washer-like members being fixedly attached to opposite ends of said spring to lie in substantially parallel planes.

6. The invention according to claim 4 wherein said bolt includes a pair of integral, radial ears and said lower washer-like member includes a pair of radial slots at its inner periphery positioned and shaped for engagement by said ears.

7. The invention according to claim 1 wherein said shell includes an integral, annular collar at said lower end thereof, and said engagement surface is integrally formed as the lower surface of said collar.

8. The invention according to claim 7 wherein said first stop means comprises a pair of stepped shoulders, positioned 180° apart on said collar and both lying in a plane extending radially through the axis of said shell and at the terminus of spiral surfaces.

9. The invention according to claim 8 wherein said engagement element upper end comprises a washer-like member having one surface shaped substantially identically to said engagement surface, the directions of said spiral surfaces are such that when said one surface and said engagement surface are placed in face-to-face relation, said shoulders on said one surface are in direct, rotation-transmitting engagement with said shoulders on said engagement surface when said engagement element is rotated in a counter-clockwise rotation as viewed from below.

10. The invention according to claim 9 wherein said engagement element further comprises a lower end washer-like member and a coil spring with said upper and lower end washer-like members fixedly attached to opposite ends thereof to lie in substantially parallel planes coaxially with one another and with said spring, the openings defined by said washer-like members and spring being larger than said bolt, the latter being rotationally fixed with respect to said engagement element by means of a pair fixed, radial ears on said bolt extending into a pair of radial slots in said lower washer-like member.

* * * * *